US008335446B2

(12) United States Patent
Kobayashi et al.

(10) Patent No.: US 8,335,446 B2
(45) Date of Patent: Dec. 18, 2012

(54) IMAGE FORMING APPARATUS, AND METHOD AND COMPUTER PROGRAM PRODUCT FOR IMAGE FORMING

(75) Inventors: Nobuyuki Kobayashi, Kanagawa (JP); Natsuko Kawase, Kanagawa (JP); Jun Kosako, Kanagawa (JP); Shigeyuki Ishii, Kanagawa (JP); Takahiro Kamekura, Kanagawa (JP); Takahiro Miyakawa, Kanagawa (JP); Takashi Enami, Kanagawa (JP); Miyo Taniguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 362 days.

(21) Appl. No.: 12/801,618

(22) Filed: Jun. 17, 2010

(65) Prior Publication Data

US 2010/0322679 A1 Dec. 23, 2010

(30) Foreign Application Priority Data

Jun. 18, 2009 (JP) ..... 2009-145115

(51) Int. Cl.
*G03G 15/16* (2006.01)
*G03G 15/01* (2006.01)

(52) U.S. Cl. ..... 399/66; 399/301

(58) Field of Classification Search ..... 399/66, 399/299, 301, 302, 303, 312; 347/115, 116
See application file for complete search history.

(56) References Cited

U.S. PATENT DOCUMENTS

| | | | | |
|---|---|---|---|---|
| 7,054,586 | B2 * | 5/2006 | Kuroda | 399/302 |
| 7,424,255 | B2 * | 9/2008 | Sakai | 399/301 |
| 7,706,731 | B2 * | 4/2010 | Martin et al. | 399/299 X |
| 2004/0184831 | A1 * | 9/2004 | Isobe | 399/66 |
| 2006/0280523 | A1 * | 12/2006 | Sakai | 399/301 X |
| 2010/0061752 | A1 | 3/2010 | Sudo et al. | |

FOREIGN PATENT DOCUMENTS

| | | |
|---|---|---|
| JP | 2001-175091 | 6/2001 |
| JP | 2002-351280 | 6/2002 |
| JP | 2004-205943 | 7/2004 |
| JP | 2004-226867 | 8/2004 |
| JP | 2006-085138 | 3/2006 |
| JP | 2006-195016 | 7/2006 |

* cited by examiner

*Primary Examiner* — Sandra Brase
(74) *Attorney, Agent, or Firm* — Harness, Dickey & Pierce, P.L.C.

(57) ABSTRACT

An image forming apparatus includes an encoder that detects a first pulse signal relevant to a conveyance velocity of an intermediate transfer belt, an encoder that detects a second pulse signal relevant to a conveyance velocity of a transfer-paper conveying belt, a print control unit that performs feedback control by using a count value of the first pulse signal per unit time and a target conveyance velocity value common between the conveyance velocity of the intermediate transfer belt and that of the transfer-paper conveying belt so that the conveyance velocity of the intermediate transfer belt attains the target value and also performs feedback-control by using a count value of the second pulse signal per unit time and the target value so that the conveyance velocity of the transfer-paper conveying belt attains the target value.

10 Claims, 10 Drawing Sheets

| COUNT VALUE | SET VALUE OF ROTATION SPEED RATE |
|---|---|
| 988 TO 992 | 102% |
| 993 TO 997 | 101% |
| 998 TO 1004 | 100% |
| 1005 TO 1009 | 99% |
| 1010 TO 1014 | 98% |
| 1015 TO 1019 | 97% |

80

IMAGE FORMING APPARATUS, AND METHOD AND COMPUTER PROGRAM PRODUCT FOR IMAGE FORMING

CROSS-REFERENCE TO RELATED APPLICATIONS

The present application claims priority to and incorporates by reference the entire contents of Japanese Patent Application No. 2009-145115 filed in Japan on Jun. 18, 2009.

BACKGROUND OF THE INVENTION

1. Field of the Invention

The present invention is directed to image forming apparatus, and method and computer program product for image forming.

2. Description of the Related Art

Electrophotographic apparatuses, such as color copiers and color printers, adopting color printing are increasing in number to meet demands of market. Because color printing is desired to achieve printing speed comparable to that of monochrome printing particularly these days, tandem image forming apparatus that includes a photosensitive member and a developing device for each of multiple colors and forms a color image by forming a single-color toner image on each of the photosensitive members and sequentially transferring the single-color toner images onto transfer paper has become mainstream.

In recent years, a number of techniques related to image forming apparatuses that perform full-color printing by using both a direct transfer system and an indirect transfer system have been disclosed (Japanese Patent Application Laid-open No. 2006-85138, for example).

Such an image forming apparatus typically performs full-color printing by using two belts, or specifically an intermediate transfer belt and a transfer-paper conveying belt. If the two belts moving at different conveyance velocities are brought into contact with each other in a transfer operation, color misregistration (misalignment) in the sub-scanning direction can disadvantageously occur.

It is also disadvantageous that if the belts moving at different conveyance velocities come into contact, it can result in fast development of wear of the belts or abrasions on the belts.

SUMMARY OF THE INVENTION

It is an object of the present invention to at least partially solve the problems in the conventional technology.

According to an aspect of the present invention, there is provided an image forming apparatus that includes a direct-transfer control unit that causes a single-color-image forming unit and a direct transfer member to transfer an image formed by the single-color-image forming unit onto any one of the direct transfer member and transfer paper conveyed by the direct transfer member; an indirect-transfer control unit that causes a multiple-color-image forming unit and an intermediate transfer member to superimpose different color images formed by the multiple-color-image forming unit onto the intermediate transfer member; a first detecting unit that detects first information relevant to conveyance velocity of the intermediate transfer member; a second detecting unit that detects second information relevant to conveyance velocity of the direct transfer member; and a print control unit that causes at least any one of the direct-transfer control unit and the indirect-transfer control unit based on the first information detected by the first detecting unit and the second information detected by the second detecting unit to make the conveyance velocity of the intermediate transfer member and the conveyance velocity of the direct transfer member equal to each other.

According to another aspect of the present invention, there is provided an image forming method to be executed in an image forming apparatus. The image forming apparatus includes a single-color-image forming unit, a direct transfer member, a direct-transfer control unit, a multiple-color-image forming unit, an intermediate transfer member, an indirect-transfer control unit, a print control unit, and a storage unit. The image forming method includes transferring, under control of the direct transfer control unit, an image formed by the single-color-image forming unit onto any one of the direct transfer member and a transfer paper conveyed by the direct transfer member; superimposing, under control of the indirect-transfer control unit, different color images formed by the multiple-color-image forming unit onto the intermediate transfer member; and causing, under control of the print control unit, at least any one of the direct-transfer control unit and the indirect-transfer control unit based on first information relevant to conveyance velocity of the intermediate transfer member and second information relevant to conveyance velocity of the direct transfer member to make the conveyance velocity of the intermediate transfer member and the conveyance velocity of the direct transfer member equal to each other.

According to still another aspect of the present invention, there is provided a computer program product embodied in a computer readable medium containing instructions that, when executed by a computer, causes the computer to function as a direct-transfer control unit that causes a single-color-image forming unit and a direct transfer member to transfer an image formed by the single-color-image forming unit onto any one of the direct transfer member and transfer paper conveyed by the direct transfer member; an indirect-transfer control unit that causes a multiple-color-image forming unit and an intermediate transfer member to superimpose different color images formed by the multiple-color image forming unit onto the intermediate transfer member; and a print control unit that causes at least any one of the direct-transfer control unit and the indirect-transfer control unit based on first information relevant to conveyance velocity of the intermediate transfer member and second information relevant to conveyance velocity of the direct transfer member to make the conveyance velocity of the intermediate transfer member and the conveyance velocity of the direct transfer member equal to each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of image forming apparatus, method and computer program product for image forming according to the present invention are explained in detail below with reference to the accompanying drawings.

First Embodiment

A first embodiment of the present invention will be described with reference to FIG. 1. The first embodiment is an example in which an image forming apparatus is embodied in what is called a multifunction peripheral (MFP) that has two or more functions of a copying function, a facsimile (FAX) function, a scanner function, a function of distributing an input image (a scanned image of an original or an image obtained by using a printer or FAX function), and the like.

Figure 1:
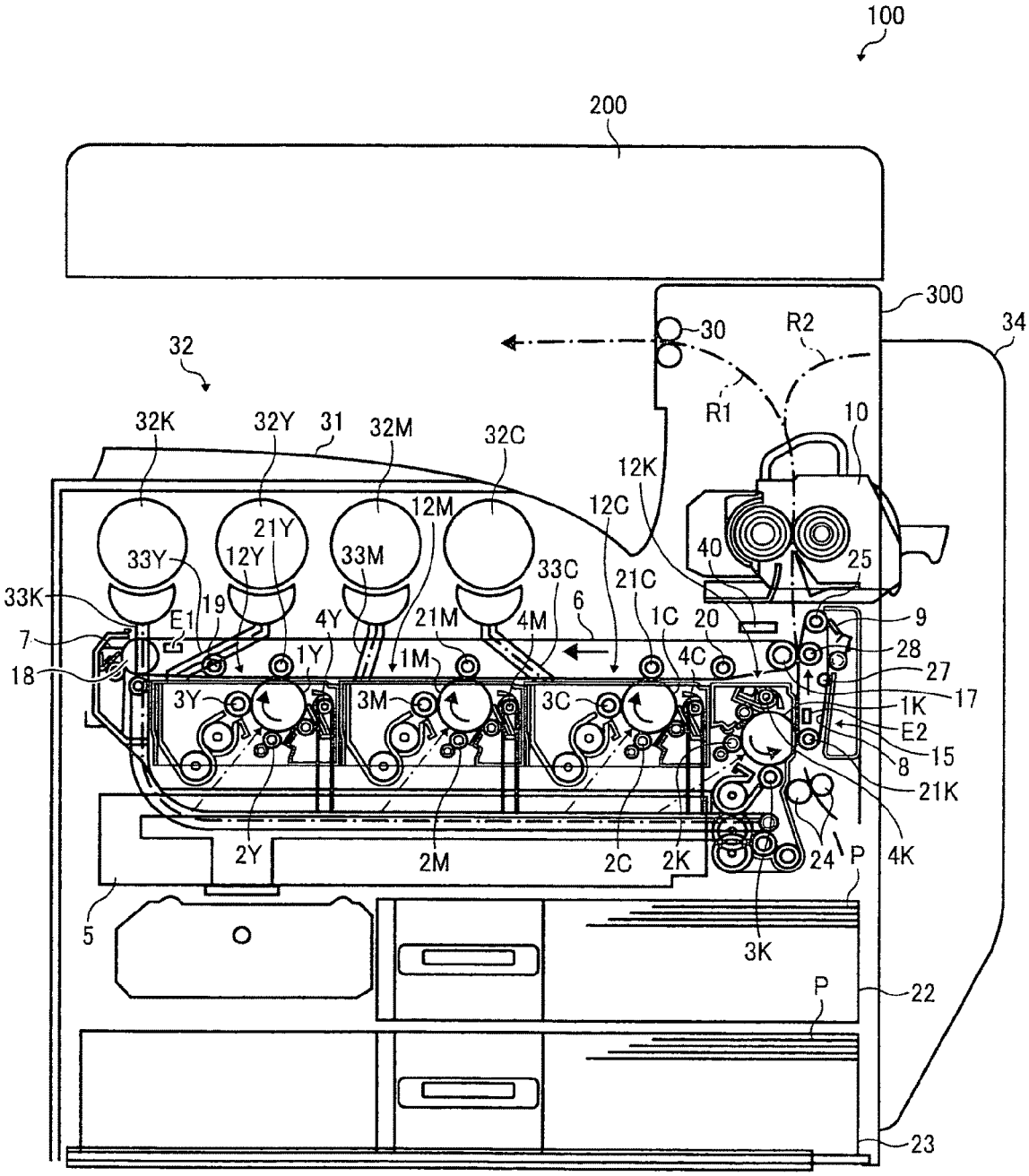
FIG. 1 is a schematic configuration diagram of a multifunction peripheral according to a first embodiment of the present invention.

FIG. 1 is a schematic configuration diagram of an MFP 100 according to the first embodiment. As illustrated in FIG. 1, the MFP 100 includes a scanner unit 200, which is an image reading device, and a printer unit 300, which is an electrophotographic image printing device. An engine control unit 500 (see FIG. 5) is configured to include the scanner unit 200 and the printer unit 300. With the MFP 100 according to the first embodiment, function can be selected by switching from one of a document box function, the copying function, the printer function, and the facsimile function to another by using an application selection key provided on an operating unit 400 (see FIG. 5). When the document box function is selected, the MFP 100 enters a document box mode; when the copying function is selected, the MFP 100 enters a copy mode; and when the facsimile mode is selected, the MFP 100 enters a facsimile mode.

The printer unit 300 having a function that characterizes the MFP 100 according to the first embodiment will be described in detail below. As illustrated in FIG. 1, the printer unit 300 of the MFP 100 is a tandem printer unit that includes three image forming units, or specifically a yellow (Y)-image forming unit 12Y, a magenta (M)-image forming unit 12M, and a cyan (C)-image forming unit 12C that are arranged in a line along a moving direction of an intermediate transfer belt 6, which is a loop extending substantially in a horizontal direction, that serves as an intermediate transfer member. The intermediate transfer belt 6 is supported by a drive roller 17, a driven roller 18, and tension rollers 19 and 20. A cleaning unit 7 that removes residual toner from the surface of the intermediate transfer belt 6 is provided and situated to face the driven roller 18 from the outer side of the intermediate transfer belt 6.

Each of the image forming units 12Y, 12M, and 12C and an image forming unit 12K for black (K) is configured as a process cartridge detachably attached to a body of the printer unit 300. Each image forming unit 12 (12Y, 12M, 12C, 12K) includes a photosensitive member 1 (1Y, 1M, 1C, 1K) serving as an image carrier, an electrifying device 2 (2Y, 2M, 2C, 2K), a developing device 3 (3Y, 3M, 3C, 3K) that supplies toner to a latent image to form a toner image, and a cleaning device 4 (4Y, 4M, 4C, 4K). In each of the image forming units 12Y, 12M, and 12C, a corresponding one of the photosensitive members 1Y, 1M, and 1C is located in contact with a lower stretched surface of the intermediate transfer belt 6. Primary transfer rollers 21Y, 21C, and 21M, each serving as primary transfer means, are provided on an inner side of the intermediate transfer belt 6 such that each of the primary transfer rollers 21Y, 21C, and 21M faces a corresponding one of the photosensitive members 1Y, 1M, and 1C.

The printer unit 300 of the MFP 100 further includes an exposure device 5 that is associated with the image forming units 12Y, 12M, 12C, and 12K of the different colors and emits laser light from laser diodes (LDs) (not shown). An image of an original read by the scanner unit 200, data received by using the facsimile function, and color image data transmitted from a computer is subjected to color separation into yellow, cyan, magenta, and black to generate single-color image data on a color-by-color basis. The single-color data is fed to the exposure device 5 associated a corresponding one of the image forming units 12Y, 12M, 12C, and 12K. With laser light emitted from the LDs of the exposure device 5, an electrostatic latent image is formed on each of the photosensitive members 1Y, 1M, 1C, and 1K of the image forming units 12Y, 12M, 12C, and 12K.

In this embodiment, the cleaning devices 4 and 9, each of which uses a doctor blade, are employed; however, other cleaning method that uses a fur brush roller or a magnetic brush can be employed. Exposure performed by the exposure device 5 is not limited to laser exposure but can be exposure by using light-emitting diodes (LEDs).

How electrophotographic image forming is performed with the configuration discussed above will be described below. An image portion on the photosensitive member 1 (1Y, 1M, 1C, 1K) is uniformly electrified by the electrifying device 2 (2Y, 2M, 2C, 2K) and then exposed with exposure light, which is emitted on a color-by-color basis from the exposure device 5. A toner image is formed on the photosensitive member 1 (1Y, 1M, 1C, 1K) by the developing device 3 (3Y, 3M, 3C, 3K). Thereafter, the color toner images formed on the photosensitive members 1Y, 1M, and 1C are transferred onto the intermediate transfer belt 6 in controlled timing, whereby a toner image, in which multiple colors are overlaid, is formed.

The printer unit 300 of the MFP 100 is further configured such that the black (K)-image forming unit 12K is located independently at a position upstream in a moving direction of transfer paper (recording medium) from the tandem arrangement discussed above. The black (K)-image forming unit 12K is arranged such that a toner image formed by the black-image forming unit 12K is directly transferred onto the transfer paper. More specifically, the black-image forming unit 12K is independent from the structure for transferring yellow, magenta and cyan images onto the intermediate transfer belt 6. A black toner image formed on the image forming unit 12K as in the case of a yellow image discussed above is directly transferred onto transfer paper P being conveyed by a transfer-paper conveying belt 8 rather than by the intermediate transfer belt 6. A secondary transfer unit 15 configured as discussed above is situated such that the secondary transfer unit 15 substantially perpendicularly intersects with the intermediate transfer belt 6 and located at a position, on a conveying path of the transfer paper P, where the multiple-color images overlaid on the intermediate transfer belt 6 and a black image transferred onto the transfer paper are superimposed on each other. More specifically, the black-image forming unit 12K is provided along and near a substantially-vertical conveying path for the transfer paper P. The secondary transfer unit 15 is positioned by utilizing space upstream from a fixing device 10 relative to the substantially-vertical conveying path.

Sheet feed trays 22 and 23 that accommodate transfer paper of different sizes are provided below the printer unit 300 of the MFP 100. Transfer paper P picked up from the sheet feed tray 22 or 23 by a paper feeding unit (not shown) is conveyed by a conveying unit (not shown) to a pair of registration rollers 24 where the transfer paper P undergoes skew correction. Thereafter the transfer paper P is conveyed by the pair of registration rollers 24 to a transfer portion between the photosensitive member 1K and the transfer-paper conveying belt 8 in a predetermined timing relation.

The printer unit 300 of the MFP 100 further includes a toner tank unit above the intermediate transfer belt 6. The toner tank unit 32 includes toner tanks 32K, 32Y, 32C, and 32M, each of which is connected to a corresponding one of the developing devices 3Y, 3M, 3C, and 3K via a corresponding one of toner supply pipes 33K, 33Y, 33C, and 33M. Because the black-image forming unit 12K is independently located from the yellow, magenta, and cyan-image forming units 12Y, 12M, and 12C, undesirable mixing of yellow, magenta, or cyan toner into a black-image forming process will not occur. This allows toner collected from the photosensitive member 1K to be conveyed by way of a black-toner collecting path (not shown) to the developing device 3K to be reused. On the black-toner collecting path, a device that removes paper dust and/or a mechanism that allows switching to a toner discarding path can be provided.

Figure 2:
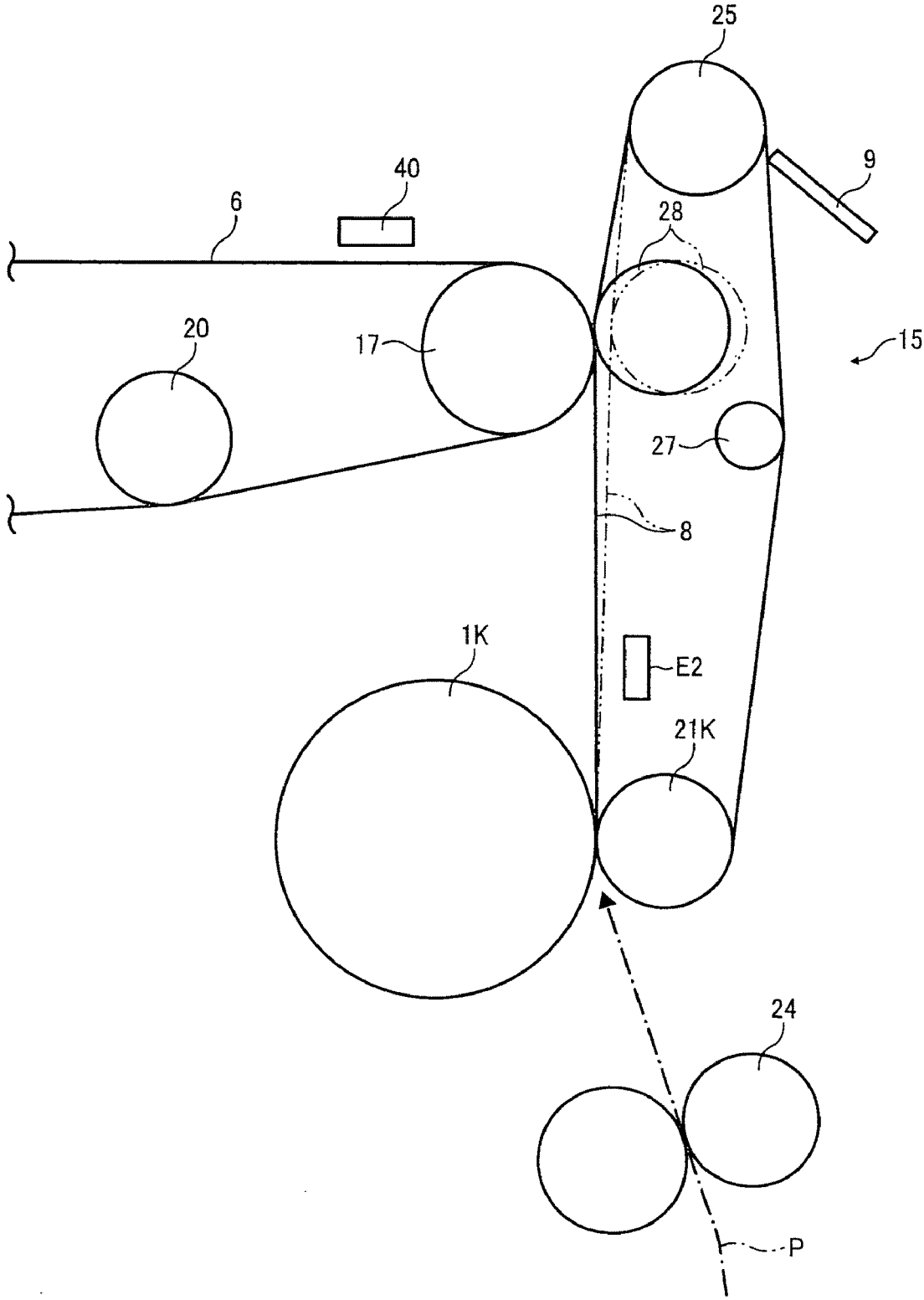
FIG. 2 is a diagram schematically illustrating a structure for bringing a secondary transfer roller away from an intermediate transfer belt.

FIG. 2 is a diagram schematically illustrating the configuration of the secondary transfer unit 15. As illustrated in FIG. 2, the secondary transfer unit 15 includes, as relevant elements thereof, a transfer-paper conveying belt 8 serving as a direct transfer member, a drive roller 25 that supports the transfer-paper conveying belt 8, a driven roller 21K that serves also as a transfer unit, a tension roller 27, a secondary transfer roller 28 serving as secondary transfer means, and the cleaning device 9 that cleans the surface of the transfer-paper conveying belt 8. The secondary transfer roller 28 is located to face the drive roller 17 of the intermediate transfer belt 6 and configured such that a bringing-into-and-out-of-contact mechanism (not shown) and tension on the transfer-paper conveying belt 8 maintained by the tension roller 27 allow the secondary transfer roller 28 to come close to the intermediate transfer belt 6 as indicated by solid lines in FIG. 2 or separate from the intermediate transfer belt 6 as indicated by a dashed double-dotted line in FIG. 2.

For instance, in color printing, a secondary-transfer control unit 55, which will be described later, controls the intermediate transfer belt 6 and the secondary transfer roller 28 to come close to each other, causing an image formed on the intermediate transfer belt 6 to be transferred onto the transfer-paper conveying belt 8 or transfer paper P being conveyed by the transfer-paper conveying belt 8.

In contrast, in monochrome printing, the secondary-transfer control unit 55 controls the intermediate transfer belt 6 and the secondary transfer roller 28 to separate from each other, whereby a contacting portion of the intermediate transfer belt 6 and a contacting portion of the secondary transfer roller 28 are separated from each other, causing the image forming units 12Y, 12M, and 12C for yellow, magenta, and cyan and the intermediate transfer belt 6 not to operate.

Accordingly, in color printing, yellow, magenta, and cyan toner images superimposed on the intermediate transfer belt 6 are transferred onto the transfer paper P. That is, the transfer-paper conveying belt 8 functions as a direct transfer belt at a transfer portion for a black toner image, whereas the transfer-paper conveying belt 8 functions as a secondary transfer belt at a transfer portion for yellow, magenta, and cyan toner images on the intermediate transfer belt 6. Thereafter, the black toner image and the yellow, magenta, and cyan toner images transferred in the superimposed manner onto the transfer paper P are subjected to fixation in the fixing device 10, whereby a full-color-image printing operation is completed. The transfer paper P having undergone the fixation is conveyed to a conveying path R1 (see FIG. 1) and discharged by a pair of paper delivery rollers 30 face down onto a paper output tray 31 to be stacked thereon. In a double-sided print mode, the transfer paper P is guided to a conveying path R2 by a path-switching flap (not shown), turned over by a double-sided print unit 34, and thereafter conveyed to the pair of registration rollers 24 to follow a paper discharge route similar to that in a single-sided print mode.

In contrast, in monochrome printing, an image portion on the photosensitive member 1K is subjected to exposure performed based on black image data by the exposure device 5 and then subjected to the developing device 3K, by which a toner image is formed. The thus-formed black toner image is directly transferred onto the transfer paper P conveyed by the transfer-paper conveying belt 8 and fixed onto the transfer paper P by the fixing device 10, whereby monochrome-image printing operation is completed.

The secondary transfer unit 15 according to the first embodiment is configured such that the secondary transfer roller 28 is to be displaced; however, the configuration of the secondary transfer unit 15 is not limited thereto. Another configuration, in which the entire transfer-paper conveying belt 8 is pivoted about the driven roller 21K to be displaced, can alternatively be employed.

Another scheme that causes, when forming a monochrome image, an intermediate transfer belt to be separated from image carriers of colors other than block has conventionally been known. When this scheme is employed, it is required to drive only the intermediate transfer belt, making it unnecessary to drive (idle) image forming units of the colors other than black; however, because the intermediate transfer belt is to be displaced, it is inevitable that tension applied onto the intermediate transfer belt disadvantageously fluctuates. By contrast, when the configuration that causes the secondary transfer roller 28 to be displaced or the configuration that causes the entire transfer-paper conveying belt 8 to be displaced is employed, the transfer-paper conveying belt 8 whose peripheral length is considerably larger than that of the intermediate transfer belt 6 is moved into and out of contact with the intermediate transfer belt 6 left unmoved (the intermediate transfer belt 6 does not move together with the transfer-paper conveying belt 8). Consequently, fluctuation of the tension applied onto the intermediate transfer belt 6 does not occur. Put another way, a configuration, in which the intermediate transfer belt 6 is brought into and out of contact with the transfer-paper conveying belt 8, can be employed, this configuration is disadvantageous in that positional accuracy related to color registration can decrease with time. In contrast, according to the first embodiment, because it is allowed to keep the intermediate transfer belt 6 in contact with the photosensitive members 1Y, 1M, and 1C for yellow, magenta, and cyan, accuracy of positioning between rollers relative to the intermediate transfer belt 6 can be set high, by which a margin on the side of the belt increases. Furthermore, because movement of the belt is stabilized, margin allowed for misalignment in full-color printing can be increased.

Still another configuration, in which the drive roller 17 that supports the intermediate transfer belt 6 is displaced by a bringing-into-and-out-of-contact mechanism (not shown) so that the tension roller 27 maintains tension applied on the intermediate transfer belt 6 to bring the intermediate transfer belt 6 into and out of contact with the transfer-paper conveying belt 8, can be employed. Because this configuration does not cause angular displacement of transfer paper P being conveyed, unstable movement of the transfer paper P between the transfer-paper conveying belt 8 and the fixing device 10 will not occur. Accordingly, the transfer paper P out of the fixing device 10 is prevented from having wrinkles or adverse effect on an image formed on the paper P. Still another configuration, in which both the secondary transfer roller 28 of the secondary transfer unit 15 and the drive roller 17 that supports the intermediate transfer belt 6 are moved to bring the intermediate transfer belt 6 and the transfer-paper conveying belt 8 into and out of contact, can be employed.

As illustrated in FIG. 1, the MFP 100 of the first embodiment includes an encoder E1, which is provided on the intermediate transfer belt 6, that serves as a first detecting unit for use in detecting conveyance velocity of the intermediate transfer belt 6 and an encoder E2, which is provided on the transfer-paper conveying belt 8, that serves as a second detecting unit for use in detecting conveyance velocity of the transfer-paper conveying belt 8.

Figure 3:
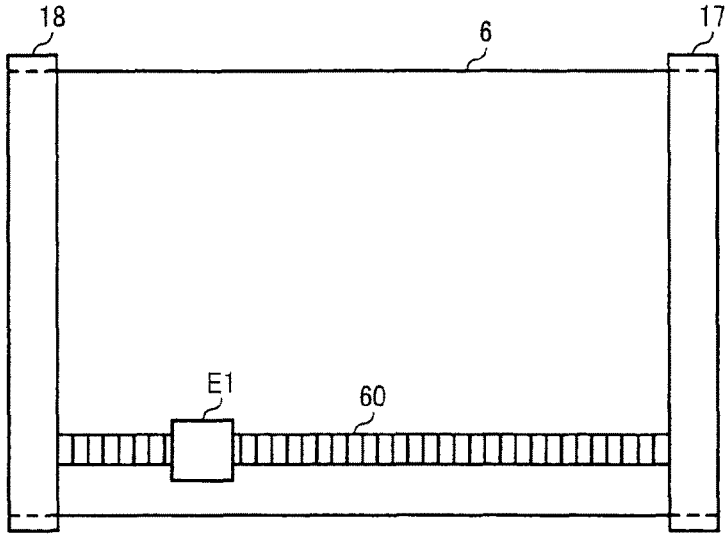
FIG. 3 is an explanatory schematic diagram of an encoder and a velocity-control graduated scale provided on the back surface of the intermediate transfer belt.

As illustrated in FIG. 3, the intermediate transfer belt 6 includes, on a surface (hereinafter, "back surface of the intermediate transfer belt 6") opposite from an image-transfer surface of the intermediate transfer belt 6, a velocity-control graduated scale 60 that is marked with straight-line segments arranged at regular intervals in the sub-scanning direction and extends in the rotating direction of and all around the belt.

Figure 4:
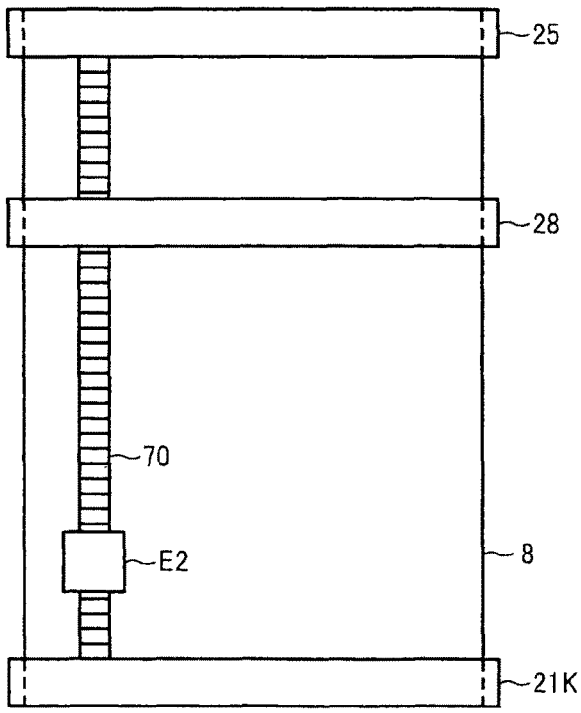
FIG. 4 is an explanatory schematic diagram of an encoder and a velocity-control graduated scale provided on the back surface of a transfer-paper conveying belt.

Similarly, as illustrated in FIG. 4, the transfer-paper conveying belt 8 includes, on a surface (hereinafter, "back surface of the transfer-paper conveying belt 8") opposite from a transfer-paper conveying surface of the transfer-paper conveying belt 8, a velocity-control graduated scale 70 that is marked with straight-line segments arranged at regular intervals in the sub-scanning direction and extends in the rotating direction of and all around the belt.

The encoder E1, which is a general phototransmitting-and-photoreceiving sensor, is located within an area where the encoder E1 is capable of detecting the velocity-control graduated scale 60 from the back surface of the intermediate transfer belt 6. The encoder E2, which is a general phototransmitting-and-photoreceiving sensor as with the encoder E1, is located within an area where the encoder E2 is capable of detecting the velocity-control graduated scale 70 from the back surface of the transfer-paper conveying belt 8.

When conveyance of the intermediate transfer belt 6 is started, the encoder E1 detects a pulse signal S1 obtained from the velocity-control graduated scale 60. When conveyance of the transfer-paper conveying belt 8 is started, the encoder E2 detects a pulse signal S2 obtained from the velocity-control graduated scale 70.

The printer unit 300 of the MFP 100 further includes pattern detecting sensors 40 that detect registration-control patterns 13 (see FIG. 10) formed on the intermediate transfer belt 6 for determination of an amount of skew occurred in scanning with the LDs (not shown). The pattern detecting sensors 40 are provided at a left end, center, and a right end in the width direction of the intermediate transfer belt 6.

When a reflection photosensor (regular-reflection photosensor) is used as the pattern detecting sensor 40, information for use in measurement of the amount of misalignment is obtained by illuminating the intermediate transfer belt 6 and detecting light reflected from the registration-control patterns 13 formed on the intermediate transfer belt and the intermediate transfer belt 6 with the pattern detecting sensors 40.

Meanwhile, in the above discussion, a regular-reflection photosensor is used as the pattern detecting sensor 40; however, the pattern detecting sensor 40 is not limited thereto. Alternatively, a diffused-light sensor unit that reads light diffused by the registration-control patterns 13 and the intermediate transfer belt 6 can be used as the pattern detecting sensor 40.

Skew relative to a reference color, sub-scanning misregistration, main-scanning misregistration, and magnification error in the main scanning direction can be measured by using a registration control function. Actual reading is performed by reading edge portions of the registration-control patterns 13. Registration control will be described in detail later.

Figure 5:
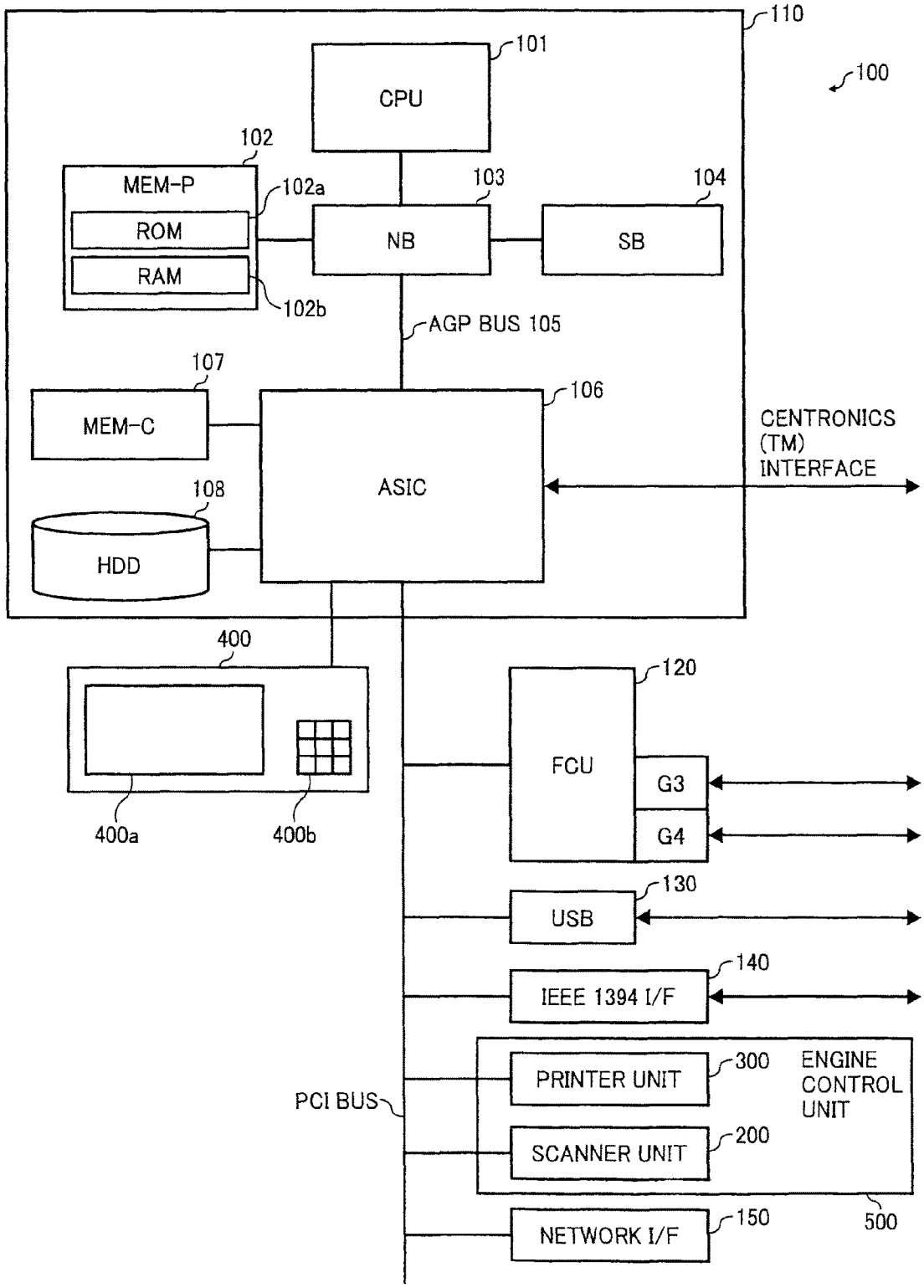
FIG. 5 is a block diagram illustrating a hardware structure of the multifunction peripheral.

A hardware structure of the MFP 100 will be described below. FIG. 5 is a block diagram illustrating the hardware structure of the MFP 100. As illustrated in FIG. 5, the MFP 100 includes a controller 110, the printer unit 300, and the scanner unit 200 that are connected via a peripheral component interconnect (PCI) bus. The controller 110 is a controller that controls the overall MFP 100, picture processing, communications, and inputs entered from the operating unit 400. The printer unit 300 or the scanner unit 200 includes an image processing section that performs error diffusion, gamma conversion, and the like. The operating unit 400 includes an operating-and-displaying unit 400*a* that displays document image information pertaining to an original scanned in by the scanner unit 200 or the like on a liquid crystal display (LCD) and receives a control input entered by an operator from a touch panel, and a keyboard unit 400*b* that receives a key entry entered by the operator.

The controller 110 includes a central processing unit (CPU) 101, which is a principal section of a computer, a system memory (hereinafter, "MEM-P") 102, a north bridge (NB) 103, a south bridge (SB) 104, an application-specific integrated circuit (ASIC) 106 that is connected to the NB 103 via an accelerated graphics port (AGP) bus 105, a local memory (hereinafter, "MEM-C") 107, which is a storage unit, and a hard disk drive (HDD) 108, which is a storage unit. The MEM-P 102 further includes a read only memory (ROM) 102*a* and a random access memory (RAM) 102*b*.

The CPU 101 that controls the overall MFP 100 includes a chip set that includes the NB 103, the MEM-P 102, and the SB 104. The CPU 101 is connected to another device via the chip set.

The NB 103 that is a bridge for connecting the CPU 101 to the MEM-P 102, the SB 104, and the AGP bus 105 includes a PCI master, an AGP target, and a memory controller that controls reading and writing from and to the MEM-P 102 and the like.

The MEM-P 102 that includes the ROM 102*a* and the RAM 102*b* is a system memory for use as a memory for storing therein computer programs and data, as a memory in which computer programs and data are to be loaded, as a memory for drawing performed by the printer, and the like. The ROM 102*a* is a read only memory for use as a memory for storing therein data and computer programs that control operations of the CPU 101. The RAM 102*b* is a writable and readable memory for use as a memory in which computer programs and data are to be loaded, as a memory for drawing performed by the printer, and the like.

The SB 104 is a bridge for connecting the NB 103 to PCI devices and to peripheral devices. The SB 104 is connected to the NB 103 via the PCI bus, to which a network interface (I/F) unit 150 and the like are also connected.

The ASIC 106 that is an integrated circuit (IC) for use in image processing includes a hardware component for the image processing, and functions as a bridge that connects the AGP bus 105, the PCI bus, the HDD 108, and the MEM-C 107 with one another. The ASIC 106 includes a PCI target and an AGP master, an arbiter (ARB) serving as the core for the ASIC 106, a memory controller that controls the MEM-C 107, a plurality of (direct memory access controllers (DMACs) that control rotation of image data and the like by a hardware logic and the like, and a PCI unit that performs data transfer to and from the printer unit 300 and the scanner unit 200 via the PCI bus. A facsimile control unit (FCU) 120, a universal serial bus (USB) 130, and an IEEE 1394 (the Institute of Electrical and Electronics Engineers 1394) interface 140 are connected to the ASIC 106 via the PCI bus.

The MEM-C 107 is a local memory for use as a copy image buffer and a code buffer. The HDD 108 is a storage for storing therein image data, font data, forms, and computer programs that control operations of the CPU 101.

The AGP bus 105 is a bus interface for a graphics accelerator card introduced to speed up graphics operations and allows direct access to the MEM-P 102 with a high throughput, thereby speeding up operations related to the graphic accelerator card.

Computer program to be executed by the MFP 100 according to the first embodiment can be provided as being preinstalled on a ROM or the like. The computer program to be executed by the MFP 100 according to the first embodiment can be provided as being recorded in a computer-readable recording medium such as a compact disk (CD)-ROM, a flexible disk (FD), a CD-recordable (CD-R), and a digital versatile disk (DVD) in an installable format or an executable format.

Another configuration, in which the computer program to be executed by the MFP 100 according to the first embodiment is stored in a computer connected to a network such as the Internet so that the computer program can be downloaded via the network, can be employed. Still another configuration, in which the computer program to be executed by the MFP 100 according to the first embodiment is provided or distributed via a network such as the Internet, can be employed.

Figure 6:
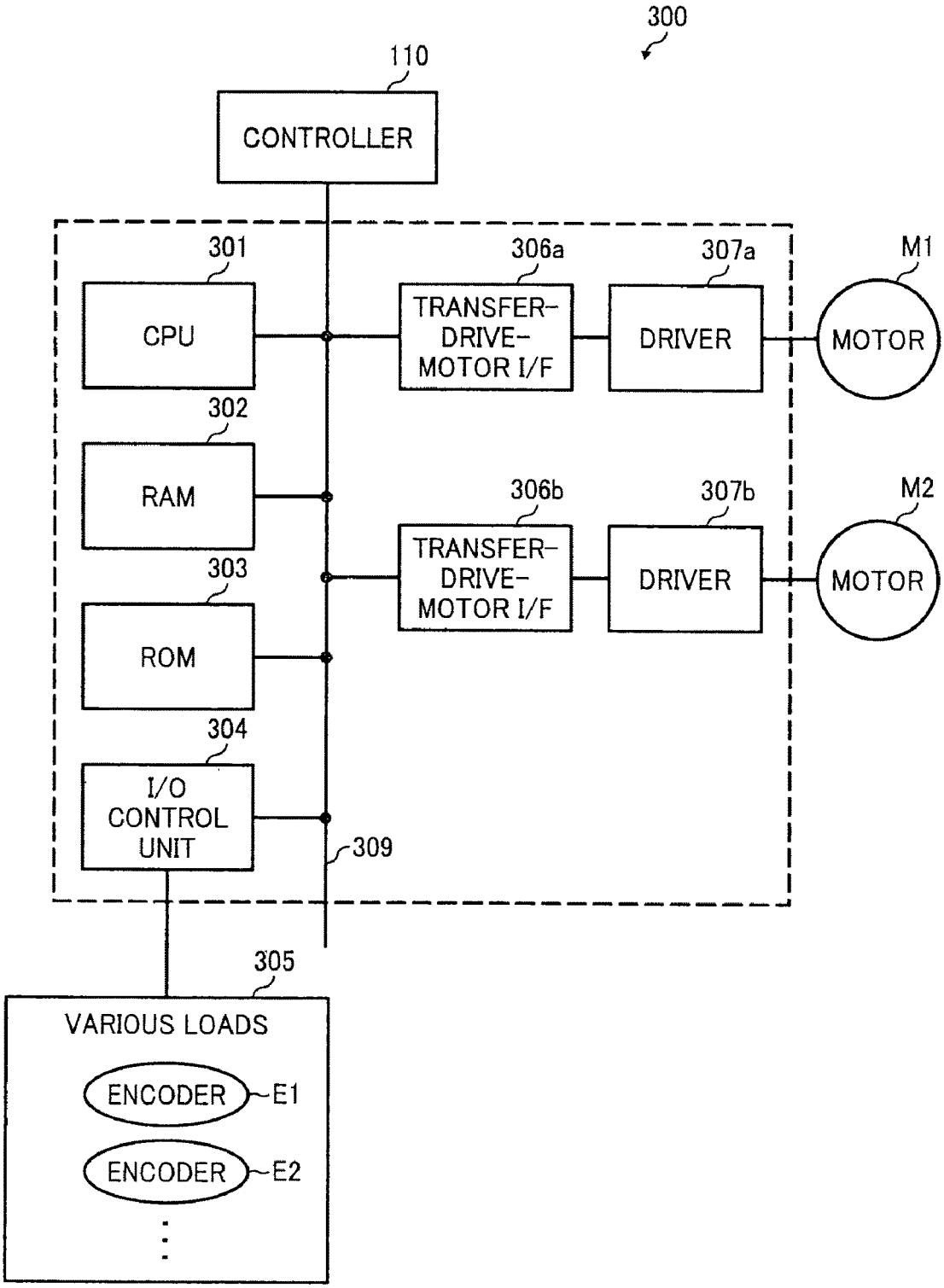
FIG. 6 is a block diagram illustrating a hardware structure of a printer unit.

FIG. 6 is a block diagram illustrating a hardware structure of the printer unit 300. As illustrated in FIG. 6, control system of the printer unit 300 includes a CPU 301, a RAM 302, a ROM 303, and an input/output (I/O) control unit 304, a transfer-drive-motor I/F 306*a*, a driver 307*a*, a transfer-drive-motor I/F 306*b*, and a driver 307*b* that are connected with one another via a bus 309.

The ROM 303 is primarily used as a memory that stores computer programs and the like.

The RAM 302 is used as a working area for use in execution of computer program stored in the ROM 303. Because the RAM 302 is a volatile memory, parameters, such as values of amplitude and phase, for use in next belt drive are stored in non-volatile memory (not shown) such as an electrically erasable programmable read only memory (EEPROM), and data of one belt cycle obtained by using a sinusoidal function or an approximate expression is written to the RAM 302 when power supply is turned on or when the drive roller 17 is operated.

When printing or registration is to be performed, the I/O control unit 304 directs various loads 305 that include motors M1 and M2, a clutch, a solenoid, a sensor, and the encoders E1 and E2 to perform operations according to an instruction fed from the CPU 301.

The CPU 301 controls the overall printer unit 300; for instance, the CPU 301 controls receiving of image data from the controller 110 and transmission and reception of control commands from and to the controller 110.

The CPU 301 provides the driver 307*a* with a specification about drive-pulse-signal frequency f1 via the transfer-drive-motor I/F 306*a*. The motor M1 starts to rotate on the drive-pulse-signal frequency f1 fed from the driver 307*a* so as to keep the velocity that is proportional to the frequency f1. By this rotation of the motor M1, the drive roller 17 illustrated in FIG. 2 is rotated, causing the intermediate transfer belt 6 to start conveyance in the direction indicated by an arrow in FIG. 1. In other words, the intermediate transfer belt 6 is rotated to move at a conveyance velocity V1 that is proportional to the frequency f1.

Similarly, the CPU 301 provides the driver 307*b* with a specification about drive-pulse-signal frequency f2 via the transfer-drive-motor I/F 306*b*. The motor M2 starts to rotate on the drive-pulse-signal frequency f2 fed from the driver 307*b* so as to keep the velocity that is proportional to the frequency f2. By this rotation of the motor M2, the drive roller 25 illustrated in FIG. 2 is rotated, causing the transfer-paper conveying belt 8 to start conveyance in the direction indicated by an arrow in FIG. 1. In other words, the transfer-paper conveying belt 8 is rotated to move at a conveyance velocity V2 that is proportional to the frequency f2.

Computer program executed by the printer unit 300 according to the first embodiment has a module configuration that includes units (a print control unit 51, a registration control unit 52, an indirect-transfer control unit 53, a direct-transfer control unit 54, and the secondary-transfer control unit 55 (see FIG. 7)) to be described later. From the viewpoint of actual hardware, the CPU 301 reads the computer program from the ROM 303 and executes the computer program to load the units on a main memory device, whereby the print control unit 51, the registration control unit 52, the indirect-transfer control unit 53, the direct-transfer control unit 54, the secondary-transfer control unit 55, and the like are generated on the main memory device.

Figure 7:
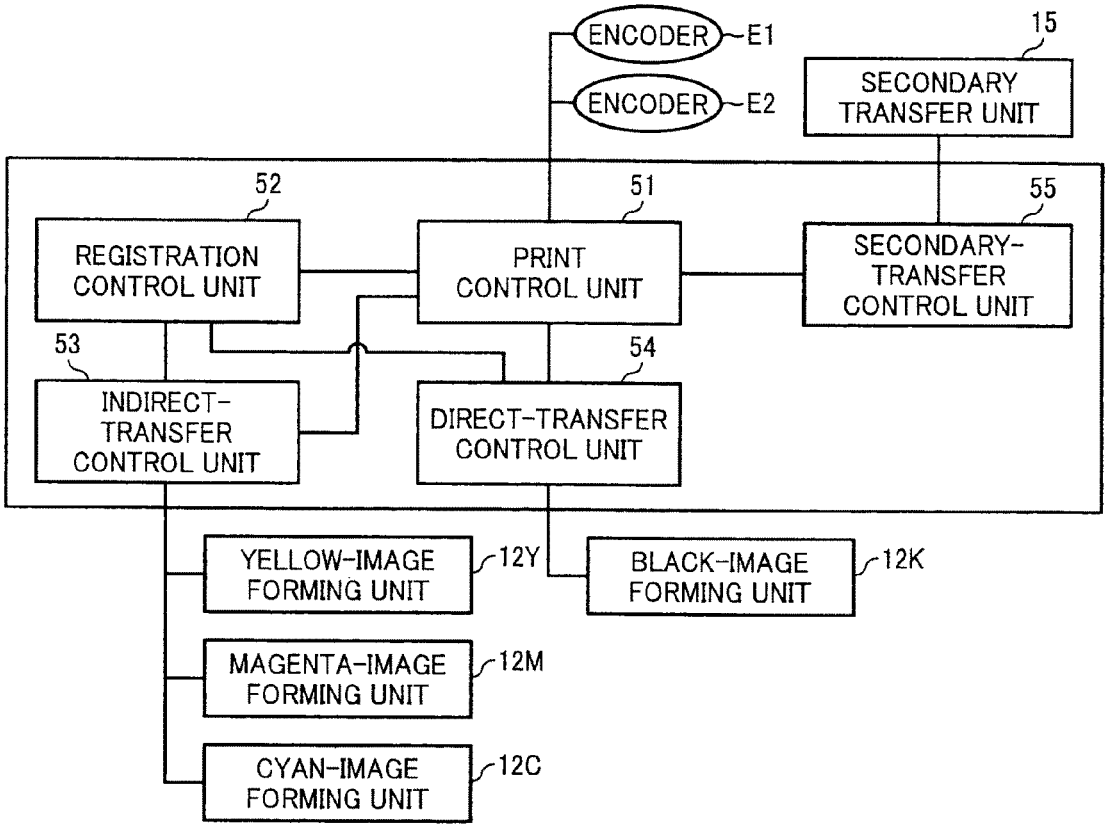
FIG. 7 is a block diagram illustrating a functional structure of the printer unit.

FIG. 7 is a block diagram illustrating a functional structure of the printer unit 300 according to the first embodiment. The printer unit 300 includes, as relevant elements thereof, the print control unit 51, the registration control unit 52, the indirect-transfer control unit 53, the direct-transfer control unit 54, and the secondary-transfer control unit 55.

Briefly, the print control unit 51 controls overall system, which includes controls the registration control unit 52, the indirect-transfer control unit 53, the direct-transfer control unit 54, and the secondary-transfer control unit 55, to perform feedback control of belt conveyance velocity, monochrome printing operation, color printing operation, registration control operation, and the like.

Meanwhile, an image forming apparatus that uses the direct transfer system and the indirect transfer system in a mixed manner includes the two belts, or specifically the intermediate transfer belt 6 and the transfer-paper conveying belt 8. Accordingly, when the two belts moving at different conveyance velocities are brought into contact for a transfer operation, it can disadvantageously result in color misregistration in the sub-scanning direction. To this end, the print control unit 51 of the first embodiment performs feedback control to make the conveyance velocity V1 of the intermediate transfer belt 6 equal to the conveyance velocity V2 of the transfer-paper conveying belt 8.

In full-color printing, the print control unit 51 directs the secondary-transfer control unit 55 to cause the secondary transfer roller 28 to come close to the intermediate transfer belt 6, and directs the indirect-transfer control unit 53 to control the image forming units 12Y, 12M, and 12C and the intermediate transfer belt 6 to perform printing operations for yellow, magenta, and cyan, and concurrently the print control unit 51 directs the direct-transfer control unit 54 to control the image forming unit 12K and the transfer-paper conveying belt 8 to perform printing operation for black.

In full-color printing, the secondary-transfer control unit 55 causes the secondary transfer roller 28 to come close to the intermediate transfer belt 6 so that the yellow, magenta, and cyan images formed on the intermediate transfer belt 6 are transferred onto the transfer paper P being conveyed by the transfer-paper conveying belt 8.

The indirect-transfer control unit 53 controls the yellow, magenta, and cyan-image forming units 12Y, 12M, and 12C and the intermediate transfer belt 6 so that the images to be transferred onto the transfer paper P are formed on the photosensitive members 1Y, 1M, and 1C. The yellow, magenta, and cyan toner images formed on the photosensitive members 1Y, 1M, and 1C are superimposed on one another on the intermediate transfer belt 6 by using the indirect transfer system.

In monochrome printing, the print control unit 51 directs the secondary-transfer control unit 55 to cause the secondary transfer roller 28 to be separated from the intermediate transfer belt 6, and directs the direct-transfer control unit 54 to control the image forming unit 12K and the transfer-paper conveying belt 8 to perform printing operation for black.

The direct-transfer control unit 54 controls the black-image forming unit 12K and the transfer-paper conveying belt 8 so that the image to be transferred onto the transfer paper P is formed on the photosensitive member 1K. The black toner image formed on the photosensitive member 1K is transferred onto the transfer paper P to thus be printed thereon at a point where the photosensitive member 1K and the driven roller 21K, which is the transfer unit, are brought into contact with each other.

In monochrome printing, because it is not necessary to transfer the yellow, magenta, and cyan toner images onto the transfer-paper conveying belt 8, the secondary-transfer control unit 55 causes the secondary transfer roller 28 to be separated away from the intermediate transfer belt 6.

The print control unit 51 directs the registration control unit 52 to start a registration control operation when an instruction to start the registration control operation is entered by a user from the operating unit 400 or after a lapse of a predetermined period of time.

Upon receiving the instruction to start the registration control operation from the print control unit 51, the registration control unit 52 controls the indirect-transfer control unit 53, the direct-transfer control unit 54, the secondary-transfer control unit 55, and the like to perform the registration control operation for all the colors, or specifically black in the direct transfer system and yellow, magenta, and cyan in the indirect transfer system.

When performing the registration control operation, the secondary-transfer control unit 55 causes the secondary transfer roller 28 to come close to the intermediate transfer belt 6 so that a black registration-control pattern 13K (see FIG. 9) formed on the transfer-paper conveying belt 8 is transferred onto the intermediate transfer belt 6 to be overlaid on registration-control patterns 13Y, 13M, and 13C (see FIG. 8) on the intermediate transfer belt 6.

Figure 8:
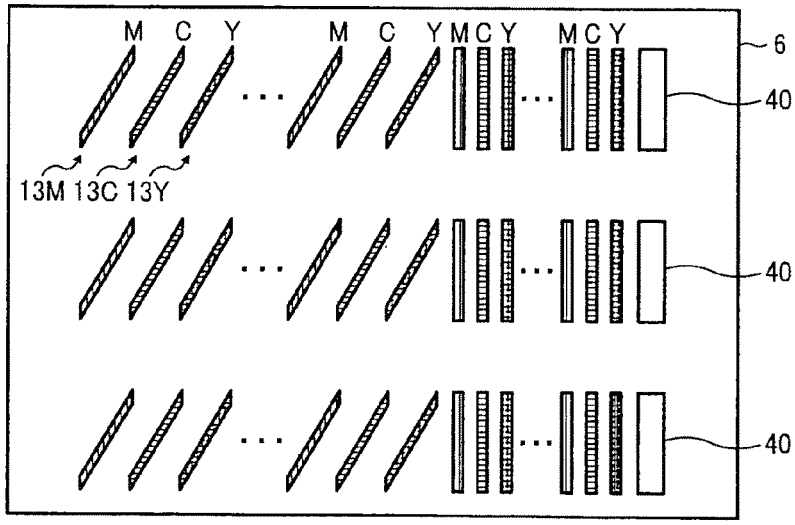
FIG. 8 is a plan view illustrating an example of registration-control patterns formed on the intermediate transfer belt.
Figure 9:
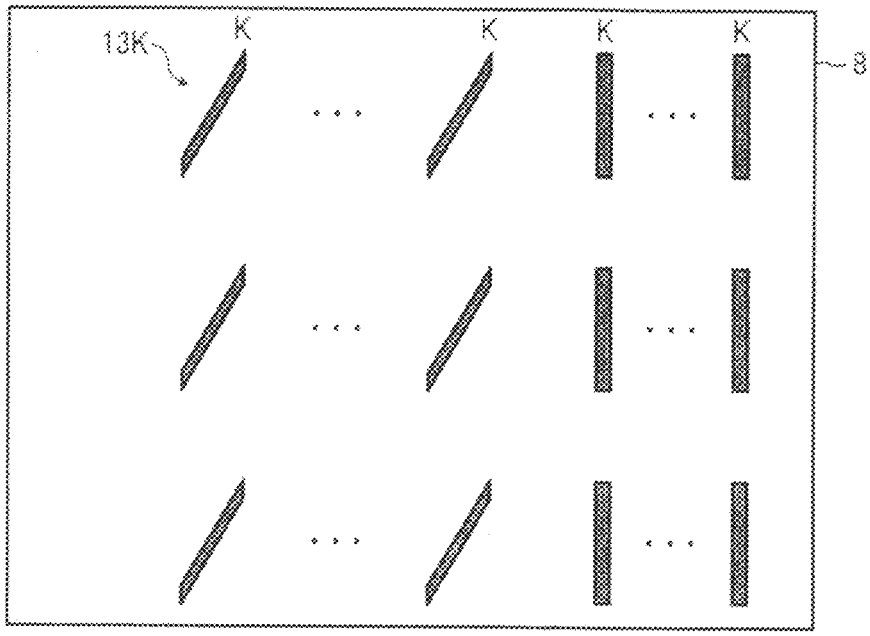
FIG. 9 is a plan view illustrating an example of registration-control patterns formed on the transfer-paper conveying belt.
Figure 10:
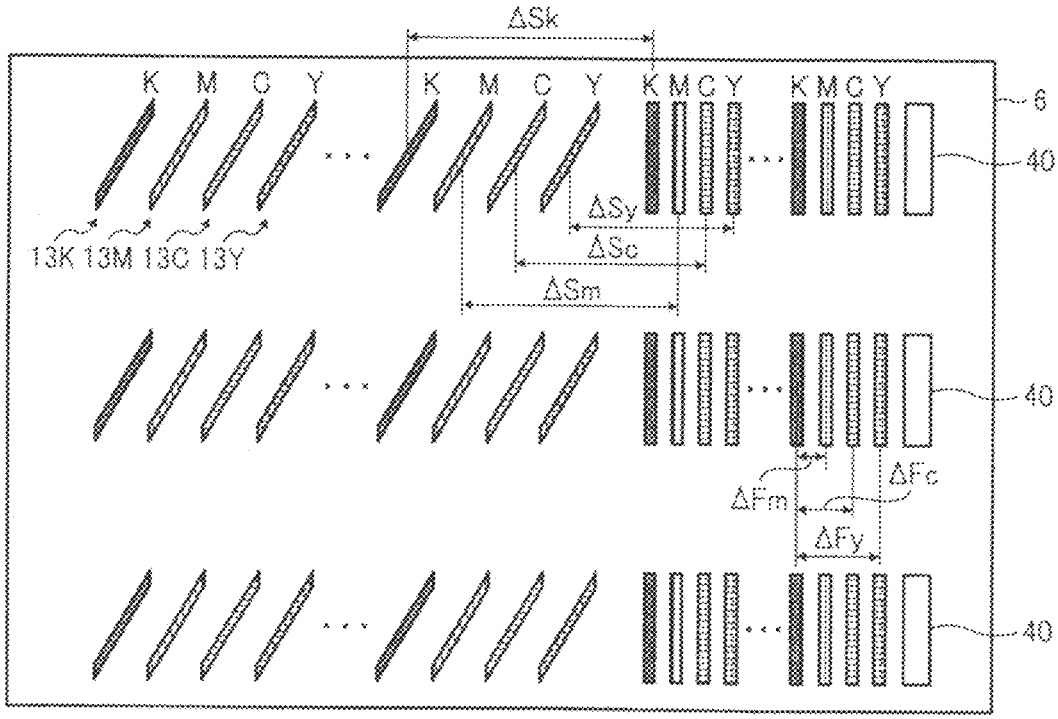
FIG. 10 is a plan view illustrating an example of registration-control patterns superimposed on the intermediate transfer belt.

The registration control operation to be performed by the registration control unit 52 will be described in detail below with reference to FIG. 8 to FIG. 10.

The registration control unit 52 causes the indirect-transfer control unit 53 and the image forming units 12Y, 12M, and 12C to form the registration-control patterns 13Y, 13M, and 13C on the intermediate transfer belt 6. FIG. 8 is a plan view illustrating an example of the registration-control patterns 13Y, 13M, and 13C formed on the intermediate transfer belt 6 by using the photosensitive members 1Y, 1M, and 1C. As illustrated in FIG. 8, the registration-control patterns 13Y, 13M, and 13C contain sets of three parallel lines of the three colors and sets of three diagonal lines of the three colors spaced at regular intervals in the sub-scanning direction. The registration-control patterns 13Y, 13M, and 13C are repeatedly formed along the moving direction of the intermediate transfer belt 6. A plurality of the registration-control patterns 13 is formed at positions corresponding to the pattern detecting sensors 40 as illustrated in FIG. 8 to increase the number of samples, thereby reducing the magnitude of influence of error.

The registration control unit 52 also causes the direct-transfer control unit 54 and the image forming unit 12K to form the registration-control pattern 13K on the transfer-paper conveying belt 8. FIG. 9 is a plan view illustrating an example of the registration-control patterns 13K formed on the transfer-paper conveying belt 8 by using the photosensitive member 1K. The registration-control pattern 13K contains longitudinal-line patterns and diagonal-line patterns arranged at regular intervals in the sub-scanning direction. The registration-control patterns 13K are repeatedly formed along the moving direction of the transfer-paper conveying belt 8.

Subsequently, the registration control unit 52 directs the secondary-transfer control unit 55 to cause the transfer-paper conveying belt 8 to come close to the intermediate transfer belt 6 so that the registration-control pattern 13K (see FIG. 9) formed on the transfer-paper conveying belt 8 is transferred onto the intermediate transfer belt 6 to be overlaid on the registration-control patterns 13Y, 13M, and 13C (see FIG. 8) formed on the intermediate transfer belt 6. FIG. 10 is a diagram illustrating the registration-control patterns 13Y, 13M, 13C, and 13K (hereinafter, referred to as "registration-control pattern 13" unless otherwise specified) superimposed on the intermediate transfer belt 6.

Subsequently, the registration control unit 52 detects the registration-control patterns 13 formed on the intermediate transfer belt 6 as discussed above by using the pattern detecting sensors 40. The registration control unit 52 further calculates an amount of main-scanning misregistration and an amount of sub-scanning misregistration based on results of detection of the registration-control patterns 13.

The registration control unit 52 measures a period of time elapsed between detection of longitudinal lines of one color by the pattern detecting sensors 40 and detection of diagonal lines of the same color by using timer function provided in the CPU 101, and, based on the thus-measured periods of time, calculates spacings ΔSy, ΔSm, ΔSc, and ΔSk (see FIG. 10) between the longitudinal lines and the diagonal lines of the same color. The registration control unit 52 performs comparison between each of the thus-calculated spacings ΔSy, ΔSm, ΔSc, and ΔSk and a corresponding one of pre-stored reference values, thereby obtaining an amount of misregistration and a correction value in the main-scanning direction.

The registration control unit 52 also measures periods of time elapsed between detection of the yellow, magenta, and cyan registration-control patterns 13Y, 13M, and 13C by the pattern detecting sensors 40 and detection of the registration-control pattern 13K of black, which is the reference color, by using the timer function provided in the CPU 101, and, based on the thus-measured periods of time, calculates a spacing ΔFy between the registration-control pattern 13K and 13Y, a spacing ΔFm between the registration-control pattern 13K and 13M, and a spacing ΔFc between the registration-control pattern 13K and 13Y. The registration control unit 52 performs comparison between each of the thus-calculated spacings ΔFm, ΔFy, and ΔFc and a corresponding one of pre-stored reference values of the spacings ΔFm, ΔFy, and ΔFc, thereby obtaining an amount of misregistration and a correction value in the sub-scanning direction.

The registration control unit 52 performs position adjustment in the main-scanning direction and in the sub-scanning direction to correct positions of images of all the colors formed by the image forming units 12Y, 12M, and 12C in the indirect transfer system and by the image forming unit 12K in the direct transfer system. By performing adjustment in this manner, registration of all the colors, or specifically, the black image formed in the direct transfer system and the yellow, magenta, and cyan images formed in the indirect transfer system is achieved, which leads to high-quality image forming.

Subsequently, how the print control unit 51 of the first embodiment performs feedback control of the conveyance velocity V1 of the intermediate transfer belt 6 and the conveyance velocity V2 of the transfer-paper conveying belt 8 will be described in detail below.

The print control unit 51 counts the number of pulses of the pulse signal S1 detected by the encoder E1 per unit time, thereby measuring a count value of the pulse signal S1 that is proportional to the conveyance velocity V1 of the intermediate transfer belt 6. Similarly, the print control unit 51 counts the number of pulses of the pulse signal S2 detected by the encoder E2 per unit time, thereby measuring a count value of the pulse signal S2 that is proportional to the conveyance velocity V2 of the transfer-paper conveying belt 8.

Meanwhile, because the count value of the pulse signal S1 is proportional to the conveyance velocity of the intermediate transfer belt 6, the count value can be assumed as information relevant to the conveyance velocity of the intermediate transfer belt 6. Similarly, because the count value of the pulse signal S2 is proportional to the conveyance velocity of the transfer-paper conveying belt 8, the count value can be assumed as information relevant to the conveyance velocity of the transfer-paper conveying belt 8. Alternatively, as information relevant to the conveyance velocity of the intermediate transfer belt 6, the conveyance velocity of the intermediate transfer belt 6 itself can be used, and as information relevant to the conveyance velocity of the transfer-paper conveying belt 8, the conveyance velocity of the transfer-paper conveying belt 8 itself can be used. Further alternatively, pulse interval or pulse frequency of the pulse signal S1 detected by the encoder E1 can be used as velocity information relevant to the conveyance velocity of the intermediate transfer belt 6, and pulse interval or pulse frequency of the pulse signal S2 detected by the encoder E2 can be used as velocity information relevant to the conveyance velocity of the transfer-paper conveying belt 8.

Figures 11, 12:
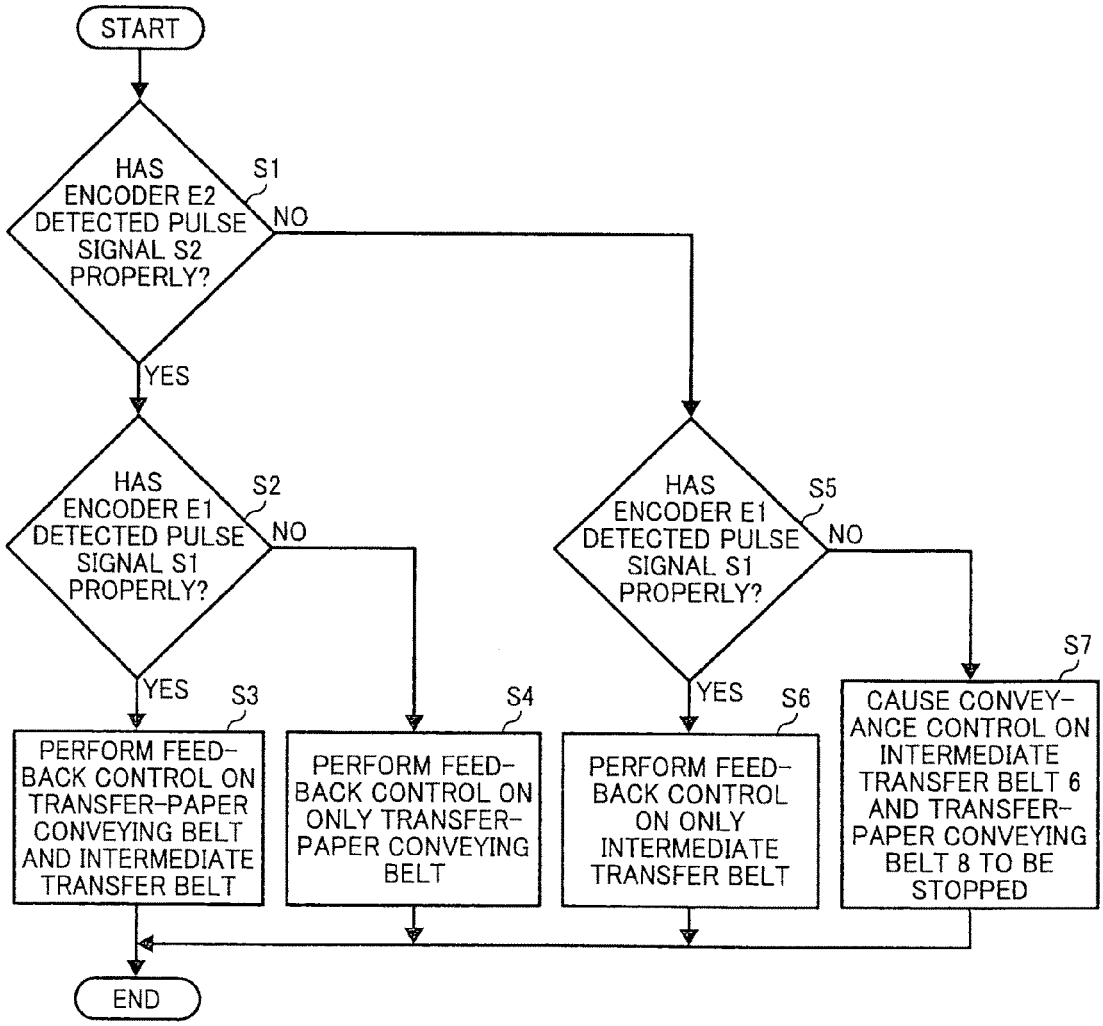
FIG. 11 is a diagram illustrating, in a simplified manner, a velocity-setting table for use in determining a rotation speed rate of a motor based on a count value.
FIG. 12 is a flowchart explaining a process procedure, through which a print control unit controls belt velocity.

In the MFP 100 according to the first embodiment, a velocity-setting table 80 illustrated in FIG. 11 is stored in the ROM 303. As illustrated in FIG. 11, count values of the pulse signal S1, S2 to be detected by the encoder E1, E2 per unit time (sampling time) are associated with rotation speed rates of the motor M1, M2 to be set by the print control unit 51 depending on detected count values, and stored in the velocity-setting table 80.

Because feedback control of the conveyance velocity V1 of the intermediate transfer belt 6 performed by the print control unit 51 is similar to feedback control of the conveyance velocity V2 of the transfer-paper conveying belt 8, how the conveyance velocity V1 of the intermediate transfer belt 6 is feedback-controlled will be described by way of an example.

In the velocity-setting table 80 given in FIG. 11, reference count value for the pulse signal S1 is set to 1000. The reference count value for the pulse signal S1 is a count value of the pulse signal S1, with which the conveyance velocity V1 of the intermediate transfer belt 6 attains a target conveyance velocity value (target velocity) V0, which is the common target value between the intermediate transfer belt 6 and the transfer-paper conveying belt 8.

Accordingly, when a count value grater than the reference value, or 1000, is detected by the encoder E1, it is indicated that the conveyance velocity V1 of the intermediate transfer belt 6 has increased. In this case, it is necessary to reduce the rotation speed of the motor M1 to maintain the conveyance velocity V1 at the target velocity V0. Accordingly, the print control unit 51 controls the indirect-transfer control unit 53 based on feedback such that when the count value is, for instance, 1005, the drive-pulse-signal frequency f1 is reduced to cause the rotation speed rate of the motor M1 attain 99% as illustrated in FIG. 11 so that the conveyance velocity V1 attains the target velocity V0.

In contrast, when a count value smaller than the reference value, or 1000, is detected by the encoder E1, it is indicated that the conveyance velocity V1 of the intermediate transfer belt 6 has decreased. In this case, it is necessary to increase the rotation speed of the motor M1 to maintain the conveyance velocity V1 at the target velocity V0. Accordingly, the print control unit 51 controls the indirect-transfer control unit 53 based on feedback such that when the count value is, for instance, 993, the drive-pulse-signal frequency f1 is increased to cause the rotation speed rate of the motor M1 attain 101% as illustrated in FIG. 11 so that the conveyance velocity V1 attains the target velocity V0.

As discussed above, the print control unit 51 controls the indirect-transfer control unit 53 based on feedback such that the rotation speed rate of the motor M1 is determined based on the difference between a detected count value of the pulse signal S1 and the reference count value, by which the drive-pulse-signal frequency f1 for the motor M1 is determined, causing the conveyance velocity V1 of the intermediate transfer belt 6 to attain the target conveyance velocity value V0 that is common between the intermediate transfer belt 6 and the transfer-paper conveying belt 8.

The print control unit 51 also performs feedback control of the conveyance velocity V2 of the transfer-paper conveying belt 8 in a manner similar to that discussed above. More specifically, the print control unit 51 controls the direct-transfer control unit 54 based on feedback such that the rotation speed rate of the motor M2 is adjusted based on a count value of the pulse signal S2 detected by the encoder E2 per unit time and the velocity-setting table 80 illustrated in FIG. 11 so that the conveyance velocity V2 of the transfer-paper conveying belt 8 attains the target velocity V0 that is common between the intermediate transfer belt 6 and the transfer-paper conveying belt 8.

Note that desirable sampling time for the pulse signals S1 and S2 is approximately 0.2 millisecond; however, not limited thereto. The sampling time can be adjusted appropriately depending on the performance of the CPU 301, performance of the encoder E1, E2 (hereinafter, referred to as "encoder E" unless otherwise specified), and the configuration of the motor M1, M2 (hereinafter, referred to as "motor M" unless otherwise specified).

In the example discussed above, both the conveyance velocity V1 of the intermediate transfer belt 6 and the conveyance velocity V2 of the transfer-paper conveying belt 8 are feedback-controlled for adjustment of the rotation speed rate of the motor M by using the velocity-setting table 80 that is shared between the direct transfer system and the indirect transfer system; however, control scheme is not limited thereto.

Alternatively, the velocity-setting table 80 illustrated in FIG. 11 can be provided individually for each of the belts. Note that, also in this case, although different reference count values can be set for the pulse signal S1 and for the pulse signal S2, a target conveyance velocity set for the intermediate transfer belt 6 and a target conveyance velocity set for the transfer-paper conveying belt 8 are to be equal to each other.

This configuration is advantageous in that, with the MFP 100 configured to include the direct transfer system and the indirect transfer system in a mixed manner, the conveyance velocities of the transfer-paper conveying belt 8 and the intermediate transfer belt 6 can be made equal to each other even when the structures of the velocity-control graduated scales 60 and 70, arrangement of the velocity-control graduated scales 60 and 70 and the encoder E, characteristics of the encoder E, characteristics of the motor E are changed in various manners.

The print control unit 51 determines, before feedback control is applied to belt conveyance, whether the encoders E1 and E2 are operating properly, and determines which one of the belts is to be feedback-controlled based on the thus-determined operating states of the encoders E1 and E2. The print control unit 51 then controls the indirect-transfer control unit 53 or the direct-transfer control unit 54 based on feedback such that the conveyance velocity V1 of the intermediate transfer belt 6 and the conveyance velocity V2 of the transfer-paper conveying belt 8 attain the target velocity V0 that is common between the intermediate transfer belt 6 and the transfer-paper conveying belt 8.

Specifically, in a case where the intermediate transfer belt 6 is being moved by rotation of the motor M1 and the encoder E1 has failed to detect the pulse signal S1 during a preset time interval determined in advance, the print control unit 51 determines that the encoder E1 has detected the pulse signal S1 improperly (the encoder E1 is malfunctioning). When the encoder E1 is malfunctioning, the print control unit 51 further determines that it is impossible to control the conveyance velocity of the intermediate transfer belt 6.

Similarly, in a case where the transfer-paper conveying belt 8 is being moved by rotation of the motor M2 and the encoder E2 has failed to detect the pulse signal S2 during a preset time interval determined in advance, the print control unit 51 determines that the encoder E2 has detected the pulse signal S2 improperly (the encoder E2 is malfunctioning). When the encoder E2 is malfunctioning, the print control unit 51 further determines that it is impossible to control the conveyance velocity of the transfer-paper conveying belt 8.

A process procedure, through which the print control unit 51 makes determination, before feedback control is applied to belt conveyance, about operating states of the encoders E1 and the encoder E2 and controls the velocity of the belt having been determined as being control-applicable, will be described below with reference to FIG. 12.

When power supply to the MFP 100 is turned on, causing the motors M1 and M2 to run and the intermediate transfer belt 6 and the transfer-paper conveying belt 8 to move, the print control unit 51 determines whether the encoder E2 is detecting the pulse signal S2 associated with the conveyance velocity V2 of the transfer-paper conveying belt 8 properly (Step S1).

When the encoder E2 is detecting the pulse signal S2 properly (Yes at Step S1), the print control unit 51 further determines whether the encoder E1 is detecting the pulse signal S1 associated with the conveyance velocity V1 of the intermediate transfer belt 6 properly (Step S2).

If the encoder E1 is detecting the pulse signal S1 properly (Yes at Step S2), the print control unit 51 controls the indirect-transfer control unit 53 based on feedback such that the rotation speed rate of the motor M1 is adjusted based on the count value of the pulse signal S1 and the velocity-setting table 80 so that the conveyance velocity V1 of the intermediate transfer belt 6 attains the target conveyance velocity value V0 (Step S3). Similarly, the print control unit 51 controls the direct-transfer control unit 54 based on feedback such that the rotation speed rate of the motor M2 is adjusted based on the difference between the count value and a reference count value of the pulse signal S2 so that the conveyance velocity V2 of the transfer-paper conveying belt 8 attains the target conveyance velocity value V0, causing the conveyance velocity V1 of the intermediate transfer belt 6 and the conveyance velocity V2 of the transfer-paper conveying belt 8 to attain the same conveyance velocity V0 (Step S3).

If the pulse signal S1 relevant to the conveyance velocity of the intermediate transfer belt 6 is detected improperly (No at Step S2), the print control unit 51 performs feedback control only of the conveyance velocity V2 of the transfer-paper conveying belt 8; specifically, the print control unit 51 controls the direct-transfer control unit 54 such that the rotation speed rate of the motor M2 is adjusted based on the count value of the pulse signal S2 and the velocity-setting table 80, causing the conveyance velocity V2 of the transfer-paper conveying belt 8 to attain the target conveyance velocity value V0 (Step S4).

When the encoder E2 is detecting the pulse signal S2 associated with the conveyance velocity V2 of the transfer-paper conveying belt 6 improperly at Step S1 (No at Step S1), the print control unit 51 further determines whether the encoder E1 is detecting the pulse signal S1 properly as in the case of Step S2 (Step S5).

If the encoder E1 is detecting the pulse signal S1 properly (Yes at Step S5), the print control unit 51 performs feedback control only of the conveyance velocity V1 of the intermediate transfer belt 6; specifically, the print control unit 51 controls the indirect-transfer control unit 53 such that the rotation speed rate of the motor M1 is adjusted based on the difference between the count value and the reference count value of the pulse signal S1, causing the conveyance velocity V1 of the intermediate transfer belt 6 to attain the target conveyance velocity value V0 (Step S6).

If the encoder E1 is detecting the pulse signal S1 improperly (No at Step S5), the print control unit 51 assumes that both the encoders E1 and E2 are malfunctioning, causes the operating unit 400 to display such a message as "failure has occurred in encoder" (not shown), and simultaneously causes the indirect-transfer control unit 53 to stop conveyance control of the intermediate transfer belt 6 and the direct-transfer control unit 54 to stop conveyance control of the transfer-paper conveying belt 8 (Step S7).

In the above discussion, the pulse signal S1 is determined as being malfunctioning when the encoder E1 has failed to detect the pulse signal S1 during the preset time interval; however, determination scheme is not limited thereto. Alternatively, the pulse signal S1 can be determined as being malfunctioning when a pulse cycle or a pulse interval of the pulse signal S1 issued by the encoder E1 has exceeded a preset limit having been determined in advance.

In the above discussion, the pulse signal S2 is determined as being malfunctioning when the encoder E2 has failed to detect the pulse signal S2 during the preset time interval; however, similarly, determination scheme is not limited thereto. Alternatively, the pulse signal S2 can be determined as being malfunctioning when a pulse cycle or a pulse interval of the pulse signal S2 issued by the encoder E2 has exceeded a preset limit having been determined in advance.

In the above discussion, before belt conveyance is started, whether velocity control is applicable to the conveyance velocities of the intermediate transfer belt 6 and the transfer-paper conveying belt 8 is determined, and feedback control is applied to the conveyance velocity of at least any one of the belts based on the result of determination; however, scheme for making selection related to feedback control is not limited thereto.

Alternatively, selection related to feedback control can be made based on a result of determination, which has been made by the print control unit 51 at start of printing, as to whether a received print job is monochrome printing that uses only the direct transfer system or color printing that uses only the direct transfer system so that the selection is made based on a print type.

For instance, a scheme that causes, if the print control unit 51 has determined that a print job is monochrome printing at start of printing, the print control unit 51 to perform feedback control only of the conveyance velocity V2 of the transfer-paper conveying belt 8 at Step S3 or Step S4 when the conveyance velocity of the transfer-paper conveying belt 8 is determined to be properly controlled at Step S1 can be employed.

A scheme that causes, if the print control unit 51 has determined that a print job is color printing at start of printing, the print control unit 51 to skip Step S1 and determine whether the conveyance velocity of the intermediate transfer belt 6 is properly controlled at Step S5, and if the control is determined to be performed properly, causing the print control unit 51 to perform feedback control only of the conveyance velocity V1 of the intermediate transfer belt 6 at Step S6 can be employed, for instance.

This is advantageous in that feedback control can be minimized depending on print type and that even when any one of the belts has fallen out of control, printing of a print type, to which feedback control remains applicable, can be performed without problem.

As discussed above, the image forming apparatus 100 according to the present embodiment is advantageous in that because the conveyance velocity of the transfer-paper conveying belt 8 and that of the intermediate transfer belt 6 are made equal to each other, occurrence of sub-scanning misregistration in an image formed by using the direct transfer system and the indirect transfer system is prevented.

The image forming apparatus 100 according to the present embodiment is also advantageous in that because the conveyance velocity of the transfer-paper conveying belt 8 and that of the intermediate transfer belt 6 are made equal to each other, wear of the belts resulting from different belt velocities can be reduced, not only a period of time over which image quality is ensured can be extended but also the number of times of part replacement due to worn belt can be reduced.

The MFP 100 according to the present embodiment is also advantageous in that even when the conveyance velocity of the intermediate transfer belt 6 has fallen out of control, it is allowed to perform feedback control only on the direct transfer system to make the conveyance velocity of the transfer-paper conveying belt 8 constant, thereby reducing misregistration in the sub-scanning direction of a black image and maintaining a level of image quality of the black image.

The MFP 100 according to the present embodiment is also advantageous in that even when the conveyance velocity of the transfer-paper conveying belt 8 has fallen out of control, it is allowed to perform feedback control only on the indirect transfer system to make the conveyance velocity of the intermediate transfer belt 6 constant, thereby reducing misregistration in the sub-scanning direction of a color image that is formed with yellow, magenta, and cyan but without black, and maintaining a level of image quality of the color image formed with yellow, magenta, and cyan.

The MFP 100 according to the present embodiment is also advantageous in that, because belt conveyance control performed by the indirect-transfer control unit 53 and the direct-transfer control unit 54 is stopped when both the conveyance velocity of the intermediate transfer belt 6 and that of the transfer-paper conveying belt 8 have fallen out of control, damage to the belts and/or fast progression of wear of components near the belts that can occur when the intermediate transfer belt 6 and the transfer-paper conveying belt 8 continue moving in a state where the conveyance velocities are out of control can be prevented.

The MFP 100 according to the present embodiment is also advantageous in that, because when both the conveyance velocity of the intermediate transfer belt 6 and that of the transfer-paper conveying belt 8 have fallen out of control, a message notifying that feedback control is no more applicable to the belts is displayed on the operating unit 400, a user can be informed about location of the problem immediately and precisely, which facilitates handling of the problem and reducing a period of time required for maintenance.

Second Embodiment

The image forming apparatus 100 according to the first embodiment includes the two belts, or specifically the intermediate transfer belt 6 and the transfer-paper conveying belt 8. Accordingly, in order to maintain accuracy in registration of all the colors, or specifically black on the direct transfer system and yellow, magenta, and cyan on the indirect transfer system, it is desirable that feedback control is performed properly, causing the conveyance velocity of the intermediate transfer belt 6 and that of the transfer-paper conveying belt 8 to be equal to each other. In view of the above circumstance, an image forming apparatus according to a second embodiment of the present invention is configured such that information as to whether registration control is to be performed when feedback control is performed improperly has been stored by a service person in a storage unit in advance, and before starting registration control, whether to perform the registration control operation is determined based on a state of feedback control and this information.

The image forming apparatus of the second embodiment includes a printer unit 2300 of which configuration differs from the configuration of the printer unit 300 according to the first embodiment. A hardware structure of the printer unit 2300 according to the second embodiment is similar to the hardware structure (see FIG. 6) of the printer unit 300 of the first embodiment.

Figure 13:
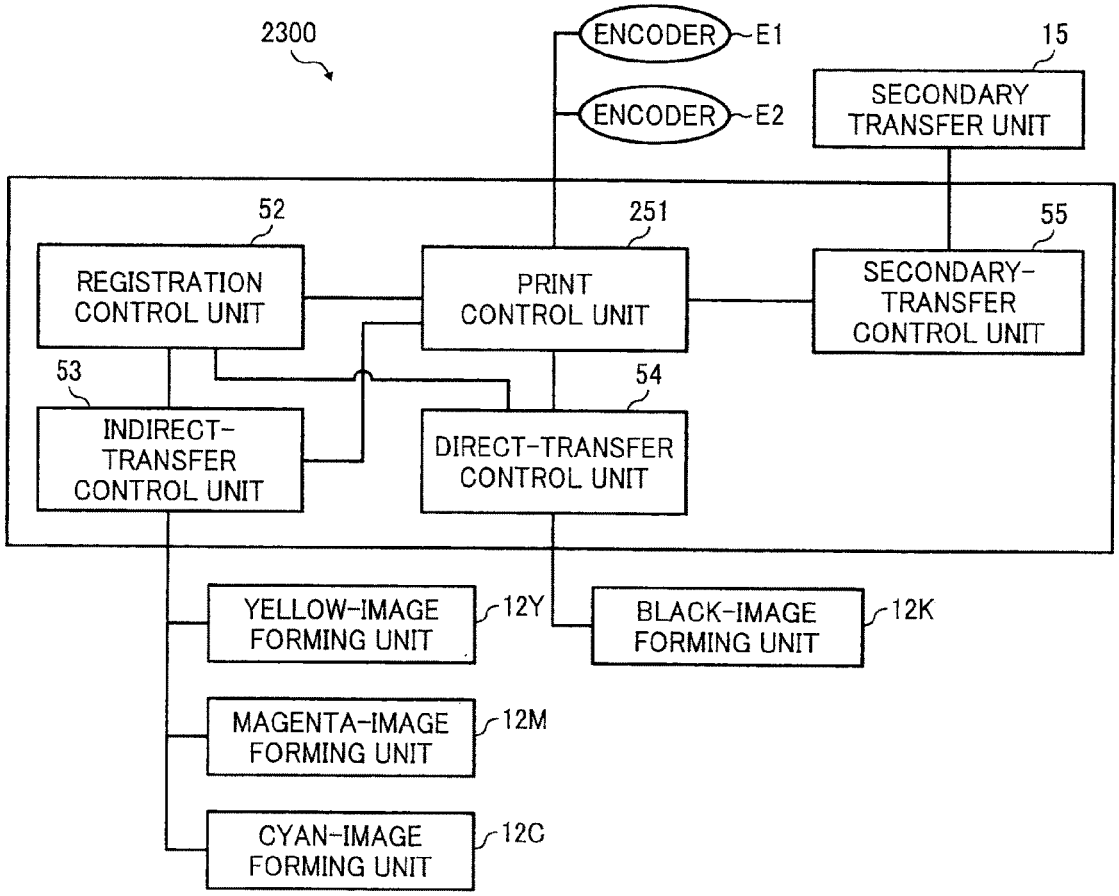
FIG. 13 is a block diagram illustrating a functional structure of a printer unit according to a second embodiment of the present invention.

FIG. 13 is a block diagram illustrating a functional structure of the printer unit 2300 according to the second embodiment of the present invention. The printer unit 2300 of the second embodiment includes, as relevant elements thereof, a print control unit 251, the registration control unit 52, the indirect-transfer control unit 53, the direct-transfer control unit 54, and the secondary-transfer control unit 55. Because functions of the registration control unit 52, the indirect-transfer control unit 53, the direct-transfer control unit 54, and the secondary-transfer control unit 55 of the second embodiment are similar to those of the first embodiment, descriptions thereabout are omitted.

The print control unit 251 has a function similar to that of the print control unit 51 of the first embodiment. Furthermore, the print control unit 251 receives from a service person an instruction, which is entered by using a service mode provided for maintenance operation or the like, as to whether to perform the registration control operation when the encoder E1 or the encoder E2 is malfunctioning, and stores the thus-input instruction to the RAM 302 by using a flag or the like. The print control unit 251 also determines, before starting registration control, whether to perform the registration control operation based on the setting of the flag.

Figure 14:
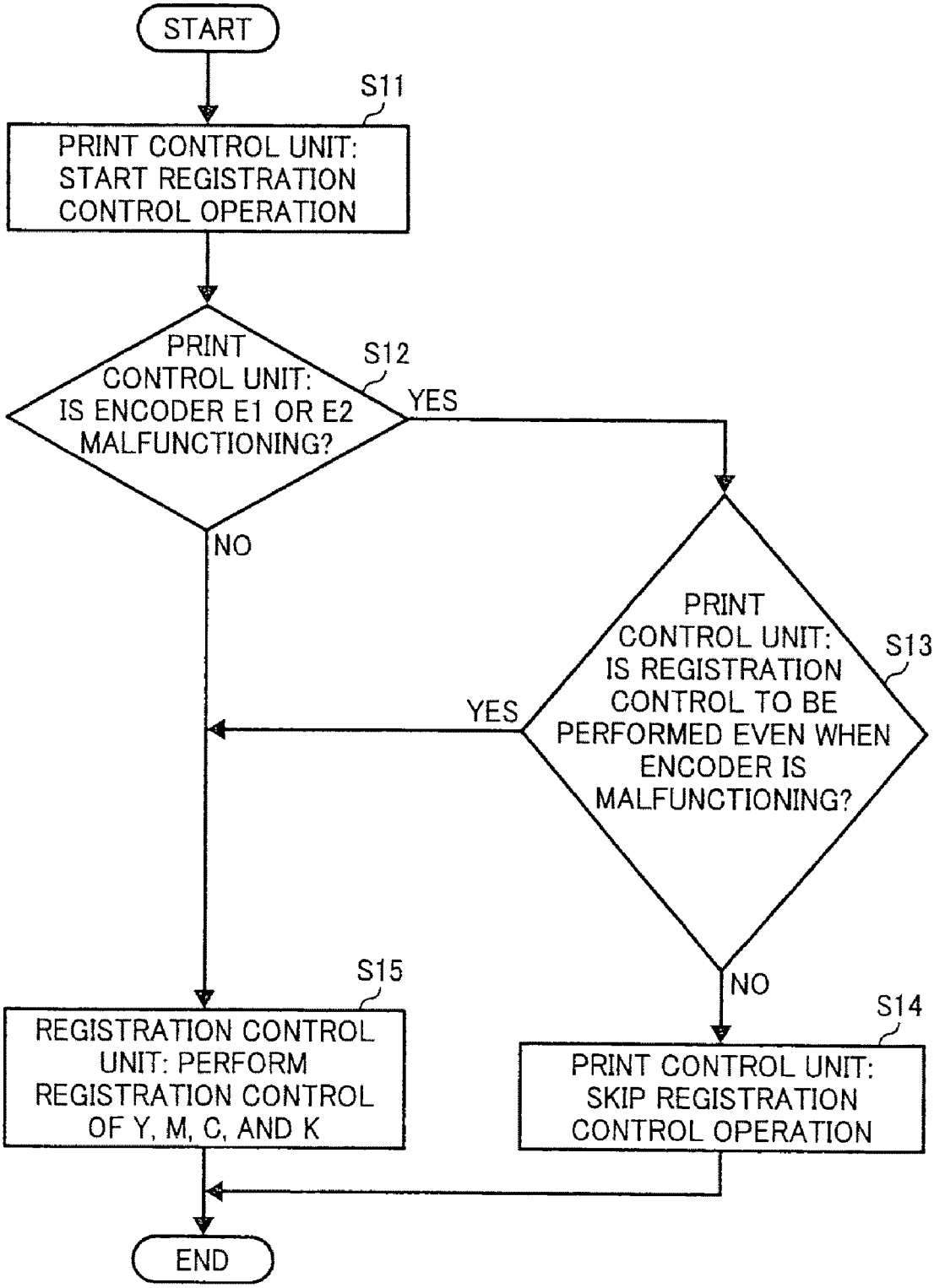
FIG. 14 is a flowchart explaining a process procedure, through which a print control unit determines whether to perform a registration control operation.

FIG. 14 is a flowchart explaining a process procedure, through which the print control unit 251 determines whether to perform the registration control operation before starting the registration control operation.

The print control unit 251 receives an instruction entered by a service person from the operating unit 400 and sets the flag discussed above in the RAM 302, thereby storing the instruction as to whether to perform the registration control operation when the encoder E is malfunctioning.

The print control unit 251 directs that the registration control operation be started (Step S11). The print control unit 251 determines whether the encoder E1 or E2 is malfunctioning (Step S12). If the encoder E1 or E2 is malfunctioning, the print control unit 251 further refers to the flag pre-stored in the RAM 302 to determine whether the setting of the flag indicates that the registration control operation is to be performed even when the encoder E is malfunctioning (Step S13). If, for instance, the value of the flag is "0" that indicates that the registration control operation is to be skipped when the encoder E1 or E2 is malfunctioning (No at Step S13), the print control unit 251 discontinues the registration control operation, by which shift to a print-standby state occurs (Step S14).

If the encoder E1 and E2 is determined not to be malfunctioning at Step S12 (No at Step S12) or the value of the flag in the RAM 302 is set to "1" that indicates that the registration control operation is to be performed even when the encoder E1 or E2 is malfunctioning (Yes at Step S13), the print control unit 251 directs the registration control unit 52 to cause the registration control unit 52 to start the registration control operation for yellow, magenta, cyan, and black (Step S15).

The MFP 100 according to the present embodiment configured as discussed above is advantageous in that, because it is allowed to circumvent a disadvantageous circumstance that the registration control operation is performed without exception even when belt conveyance velocity has fallen out of control, decrease in accuracy in registration can be prevented.

In the above discussion, the print control unit 251 is configured to determine whether the encoder E1 or E2 is operating properly; however, scheme for the determination is not limited thereto. For instance, another configuration, in which operating states of the encoders E1 and E2 are stored in the RAM 302, which is a storage unit, at start of belt conveyance, and the print control unit 251 determines whether the encoder E is operating properly by referring the RAM 302 at start of registration, can be employed.

In the above discussion, the print control unit 251 is configured to determine whether to perform the registration control operation when the encoder E1 or E2 is malfunctioning; however, scheme for the determination is not limited thereto. For instance, another configuration, in which determination as to whether to perform the registration control operation is made only when the encoder E1 in the indirect transfer system is malfunctioning but not made when the encoder E2 in the direct transfer system is malfunctioning, can be employed. This configuration is advantageous in that operation for the determination can be omitted when the encoder E2 in the direct transfer system is malfunctioning, thereby allowing registration of a multiple-color image formed by using the indirect transfer system to be performed smoothly.

According to the embodiments, because the conveyance velocity of the transfer-paper conveying belt and that of the intermediate transfer belt are made equal to each other, occurrence of sub-scanning misregistration in an image formed by using the direct transfer system and the indirect transfer system is prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a direct-transfer control unit that causes a single-color-image forming unit and a direct transfer member to transfer an image formed by the single-color-image forming unit onto any one of the direct transfer member and transfer paper conveyed by the direct transfer member;

an indirect-transfer control unit that causes a multiple-color-image forming unit and an intermediate transfer member to superimpose different color images formed by the multiple-color-image forming unit onto the intermediate transfer member;

a first detecting unit that detects first information relevant to conveyance velocity of the intermediate transfer member;

a second detecting unit that detects second information relevant to conveyance velocity of the direct transfer member; and a print control unit that causes at least any one of the direct-transfer control unit and the indirect-transfer control unit based on the first information detected by the first detecting unit and the second information detected by the second detecting unit to make the conveyance velocity of the intermediate transfer member and the conveyance velocity of the direct transfer member equal to each other.

2. The image forming apparatus according to claim 1, wherein the first and second information include first and second control parameter values, respectively, and the print control unit performs feedback control of the conveyance velocity of the intermediate transfer member by using the first control parameter value of the first information detected by the first detecting unit and a common target value of the first and second control parameter values, the common target value having been set in advance so that the direct transfer member and the intermediate transfer member are moved at a same conveyance velocity, and performs feedback control of the conveyance velocity of the direct transfer member by using the second control parameter value of the second information detected by the second detecting unit and the target value.

3. The image forming apparatus according to claim 2, wherein the print control unit determines whether the first detecting unit and the second detecting unit are operating properly, and, when the print control unit determines that the first detecting unit is operating improperly, the print control unit performs feedback control only of the conveyance velocity of the direct transfer member by using the second control parameter value and the common target value.

4. The image forming apparatus according to claim 2, wherein the print control unit determines whether the first detecting unit and the second detecting unit are operating properly, and, when the print control unit determines that the second detecting unit is operating improperly, the print control unit performs feedback control only of the conveyance velocity of the direct transfer member by using the first control parameter value and the common target value.

5. The image forming apparatus according to claim 1, wherein the print control unit determines whether the first detecting unit and the second detecting unit are operating properly, and, when the print control unit determines that both the first detecting unit and the second detecting unit are operating improperly, the print control unit causes conveyance control applied to the intermediate transfer member and the direct transfer member to be stopped.

6. The image forming apparatus according to claim 1, further comprising an displaying unit that displays a message notifying that at least one of the first detecting unit and the second detecting unit is operating improperly, wherein the print control unit determines whether the first detecting unit and the second detecting unit are operating properly, and, when the print control unit determines that the first detecting unit is operating improperly, the print control unit causes the displaying unit to display a massage notifying that the first detecting unit is operating improperly, while when the print control unit determines that the second detecting unit is operating improperly, causes the displaying unit to display a massage notifying that the second detecting unit is operating improperly.

7. The image forming apparatus according to claim 1, further comprising:

a registration control unit that performs a registration control operation of an image formed by the indirect-transfer control unit and an image formed by the direct-transfer control unit; and a storage unit that stores therein an instruction as to whether the registration control operation is to be performed by the registration control unit when the print control unit determines that at least one of the first detecting unit and the second detecting unit is operating improperly, wherein before the registration control unit starts the registration control operation, the print control unit determines whether the first detecting unit and the second detecting unit are operating properly, and when the print control unit determines that any one of the first detecting unit and the second detecting unit is operating improperly and when the instruction stored in the storage unit directs that the registration control operation be performed, the print control unit causes the registration control unit to perform the registration control operation, while when the print control unit determines that any one of the first detecting unit and the second detecting unit is operating improperly and when the instruction stored in the storage unit directs that the registration control operation not be performed, the print control unit does not allow the registration control unit to perform the registration control operation.

8. The image forming apparatus according to claim 1, wherein the image formed by the single-color-image forming unit controlled by the direct-transfer control unit is a black image.

9. An image forming method to be executed in an image forming apparatus, the image forming apparatus including a single-color-image forming unit, a direct transfer member, a direct-transfer control unit, a multiple-color-image forming unit, an intermediate transfer member, an indirect-transfer control unit, a print control unit, and a storage unit, the image forming method comprising:

transferring, under control of the direct transfer control unit, an image formed by the single-color-image forming unit onto any one of the direct transfer member and a transfer paper conveyed by the direct transfer member;

superimposing, under control of the indirect-transfer control unit, different color images formed by the multiple-color-image forming unit onto the intermediate transfer member; and causing, under control of the print control unit, at least any one of the direct-transfer control unit and the indirect-transfer control unit based on first information relevant to conveyance velocity of the intermediate transfer member and second information relevant to conveyance velocity of the direct transfer member to make the conveyance velocity of the intermediate transfer member and the conveyance velocity of the direct transfer member equal to each other.

10. A computer program product embodied in a computer readable medium containing instructions that, when executed by a computer, causes the computer to function as:

a direct-transfer control unit that causes a single-color-image forming unit and a direct transfer member to transfer an image formed by the single-color-image forming unit onto any one of the direct transfer member and transfer paper conveyed by the direct transfer member;

an indirect-transfer control unit that causes a multiple-color-image forming unit and an intermediate transfer member to superimpose different color images formed by the multiple-color image forming unit onto the intermediate transfer member; and a print control unit that causes at least any one of the direct-transfer control unit and the indirect-transfer control unit based on first information relevant to conveyance velocity of the intermediate transfer member and second information relevant to conveyance velocity of the direct transfer member to make the conveyance velocity of the intermediate transfer member and the conveyance velocity of the direct transfer member equal to each other.

* * * * *